US007685747B1

(12) United States Patent
Gasparovic et al.

(10) Patent No.: US 7,685,747 B1
(45) Date of Patent: Mar. 30, 2010

(54) FOOTWEAR ARCHITECTURE(S) AND ASSOCIATED CLOSURE SYSTEMS

(75) Inventors: David W. Gasparovic, Lake Oswego, OR (US); Daniel J. Richard, Portsmouth, NH (US)

(73) Assignee: Hatchbacks, Inc., Lake Oswego, OR (US)

( * ) Notice: Subject to any disclaimer, the term of this patent is extended or adjusted under 35 U.S.C. 154(b) by 326 days.

(21) Appl. No.: 10/425,056

(22) Filed: Apr. 28, 2003

Related U.S. Application Data

(60) Provisional application No. 60/376,777, filed on Apr. 29, 2002.

(51) Int. Cl.
*A43B 1/10* (2006.01)

(52) U.S. Cl. ..... 36/102; 36/101; 36/138; 36/58.5

(58) Field of Classification Search ..... 36/101, 36/102, 103, 105, 71 R, 7.4, 7.5, 138, 58.5, 36/50.1, 51
See application file for complete search history.

(56) References Cited

U.S. PATENT DOCUMENTS

| | | | | |
|---|---|---|---|---|
| 75,048 | A | | 3/1868 | Perley |
| 171,301 | A | | 7/1875 | McKee |
| 417,460 | A | | 12/1889 | Wurtele |
| 474,574 | A | | 5/1892 | Bruzon |
| 503,588 | A | | 8/1893 | Elterich et al. |
| 2,452,649 | A | | 11/1948 | Graves |
| 2,619,744 | A | | 12/1952 | Mattes |
| 2,853,805 | A | * | 9/1958 | Dratman ..... 36/138 |
| 3,146,535 | A | | 9/1964 | Owings |
| 3,192,651 | A | | 7/1965 | Smith |
| 3,566,488 | A | * | 3/1971 | Pilarski ..... 36/7.5 |
| 3,621,592 | A | * | 11/1971 | Goldmerstein ..... 36/138 |
| 4,095,356 | A | | 6/1978 | Robran et al. |
| 4,309,832 | A | | 1/1982 | Hunt |
| 4,559,724 | A | | 12/1985 | Norton |
| 4,562,651 | A | | 1/1986 | Frederick et al. |
| 4,944,099 | A | | 7/1990 | Davis |
| 4,972,610 | A | * | 11/1990 | Tong ..... 36/7.1 R |
| 5,184,410 | A | | 2/1993 | Hamilton |
| 5,222,313 | A | | 6/1993 | Dowdy et al. |
| 5,481,814 | A | | 1/1996 | Spencer |
| 5,570,523 | A | | 11/1996 | Lin |
| 6,018,890 | A | | 2/2000 | Bowen |
| 6,049,955 | A | | 4/2000 | Bowen |
| 6,189,239 | B1 | * | 2/2001 | Gasparovic et al. ..... 36/102 |
| 6,279,251 | B1 | | 8/2001 | Davis |
| 6,289,609 | B1 | | 9/2001 | Bowen |

* cited by examiner

*Primary Examiner*—Jila M Mohandesi
(74) *Attorney, Agent, or Firm*—Blakely Sokoloff Taylor & Zafman

(57) ABSTRACT

Footwear architecture(s) and associated closure systems. A footwear closure system is described with an anchor section, affixed to a forefoot portion of an upper of the footwear, and an engagement section, coupled with the anchor section through an elastomeric material, to removably engage a rearfoot portion of the upper of the footwear, securing the rearfoot portion to the forefoot portion.

8 Claims, 17 Drawing Sheets

FOOTWEAR ARCHITECTURE(S) AND ASSOCIATED CLOSURE SYSTEMS

RELATED APPLICATION

This non-provisional patent application claims the benefit of priority under 35 U.S.C. §119(e) of U.S. Patent Application Ser. No. 60/376,777, entitled, "Footwear Architecture(s) and Associated Closure Systems," filed on Apr. 29, 2002.

TECHNICAL FIELD

The present invention generally relates to the field of footwear and, more particularly, to enhanced closure systems for footwear and advanced footwear architectures.

BACKGROUND

Footwear, particularly footwear for active use, is simplistically comprised of a sole and an upper. The upper includes an opening to receive a foot and a throat—an elongate opening that extends from the foot opening to a vamp. A tongue is typically located in the throat opening and a shoelace is laced through edges along the throat to provide a secure closure system.

Such footwear is donned onto a foot by loosening the laces, spreading apart the foot opening and the throat, holding the tongue out of the way and then inserting a foot through the opening into the footwear. The laces of the conventional closure system may then be tightened to secure the footwear onto the wearer's foot. While this is a typical part of daily life for many people, there remains a large population for which the donning and doffing of such footwear remains an exasperating challenge.

One such population for which the donning and doffing of conventional footwear remains a challenge is for children. Children can be reluctant to remain still or cooperate while a parent struggles to put shoes on the child's feet. The adult must hold the footwear open, hold the tongue out of the way, and guide the reluctant foot into the footwear without hurting the child—difficult actions on a squirming child.

Those skilled in the art will appreciate, however, that children represent but one segment of a larger population that find the operation of convention footwear closure systems frustrating. People with limited leg mobility or other physical limitations, people with Alzheimer's disease or other mental infirmities and the like may require assistance in working the closure system of conventional footwear to don and doff such footwear.

BRIEF DESCRIPTION OF THE DRAWINGS

The present invention is illustrated by way of example, and not by way of limitation, in the figures of the accompanying drawings in which like reference numerals refer to similar elements and in which.

DETAILED DESCRIPTION

The present invention is generally directed footwear closure system(s) and, more particularly to a number of innovative enhanced closure systems (ECS) for use with any of a wide range of footwear. Those skilled in the art will appreciate, given the discussion to follow, that the enhanced closure system(s) (ECS) disclosed herein render host footwear easier to don and doff, while providing stability similar to or better than that of the conventional footwear closure system(s). In this regard, a number of alternate embodiments of an enhanced closure system (ECS) is presented, suitable for use with any of a number of alternate footwear styles for infants, youth and adults alike.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Example Enhanced Closure System Architecture

Figure 1:
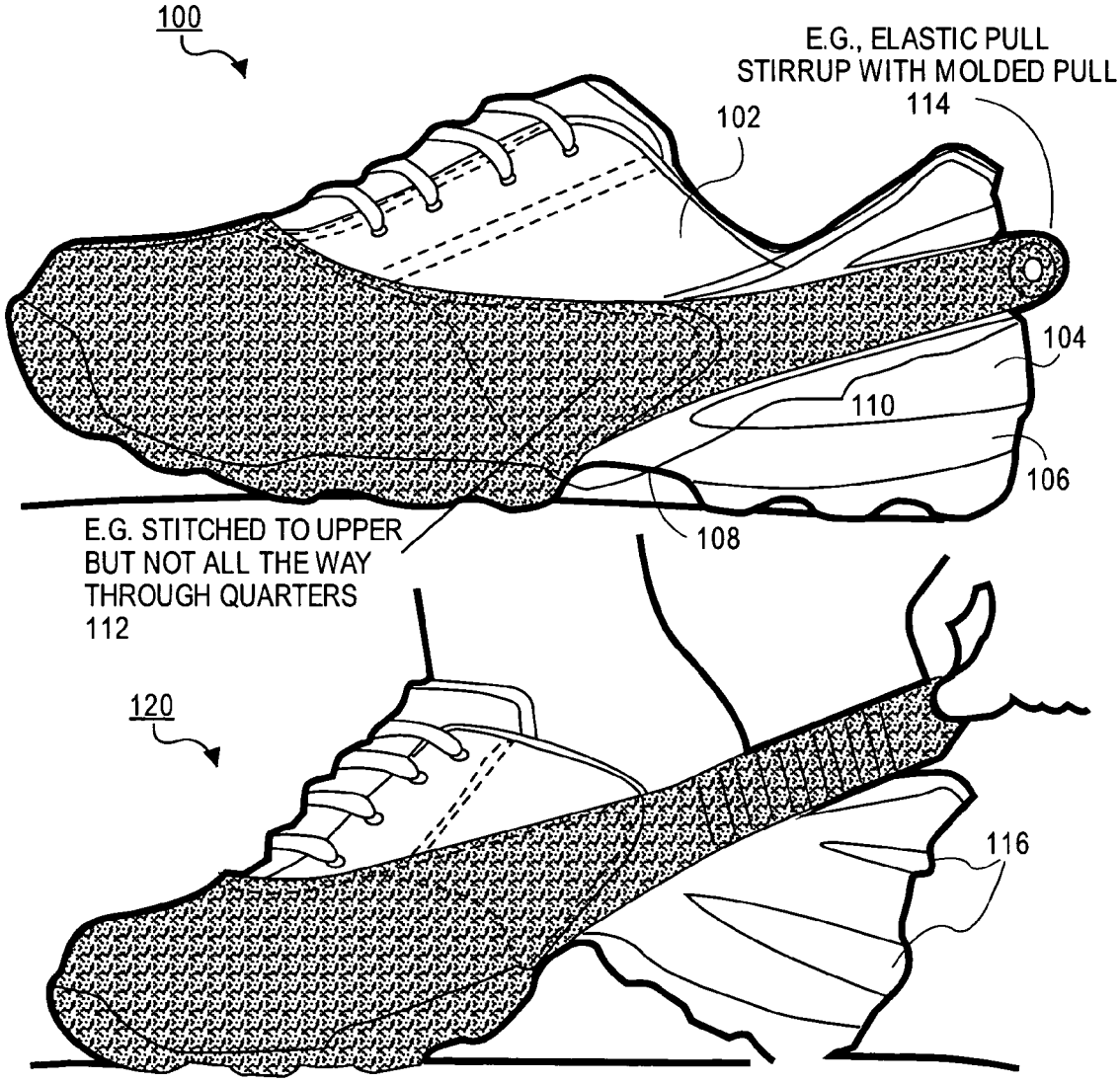
FIG. 1 is a side elevation of an article of footwear incorporating an example enhanced closure system (ECS) in accordance with but one example embodiment of the present invention.

Turning to FIG. 1, a side elevation of footwear employing an example of an innovative enhanced closure system is presented, in accordance with but one embodiment of the present invention. As shown, the footwear is depicted comprising an upper with a forefoot portion 102 and a rearfoot portion 104, a sole 106, and an example embodiment of an enhanced closure system (ECS) 110 incorporating the teachings of the present invention. As depicted, the example ECS 110 of FIG. 1 includes an anchor section 112, and a movable engagement section 114. In accordance with the illustrated example implementation of FIG. 1, illustration 100 depicts the footwear in a secured, or engaged position, i.e., in a state to secure the footwear on a foot of a user. Illustration 120 of FIG. 1 graphically depicts the footwear in an unsecured, or disengaged state. Although depicted as a number of disparate elements, those skilled in the art will appreciate that the ECS 110 may well be employed with footwear of greater or lesser complexity without deviating from the spirit and scope of the present invention.

While varying in implementation detail, each of the embodiments of the enhanced closure system (ECS) disclosed herein are preferably implemented in combination with a sole 106 including an innovative flexure member 108, first introduced in U.S. Pat. No. 6,189,239 to Gasparovic, et al., the disclosure of which is incorporated herein for all purposes. As will be developed more fully below, the stability and durability of the ECS in securing the upper(s) of the shoe, e.g., rearfoot portion to forefoot portion, make the system well suited to a wide variety of applications such as sporting shoes, hiking shoes, walking shoes, and the like. It should be noted that the illustrative example of the ECS 110 of FIG. 1 does not directly engage the foot, per se, but rather secures the rearfoot portion 114 to the forefoot portion 102 of the upper, thereby securing the foot within the footwear 100.

In accordance with the illustrated example diagram of FIG. 1, any of a wide variety of materials may well be used in constructing the ECS 110. According to one example embodiment, the anchor section 112 is comprised of a substantially non-flexible material, e.g., leather, that is secured to the forefoot portion 102 of the upper through, e.g., stitching. The engagement section 114 of the ECS 110 is comprised of a flexible material that allows a user to pull the engagement section 114 away from the rearfoot portion 104 of the footwear, thereby disengaging the closure mechanism of the shoe. To engage the closure mechanism, a user pulls the engagement mechanism out (i.e., away from the toes) and up towards an engagement mount 116, e.g., using a molded pull in the engagement section 114. Alternatively, as depicted, the engagement section 114 is pulled out (i.e., away from the toes) and up towards the heal of the foot as the rearfoot portion 104 of the shoe drops underneath the engagement section 114 of the ECS 110, thereby releasing the foot from the shoe.

Figure 2:
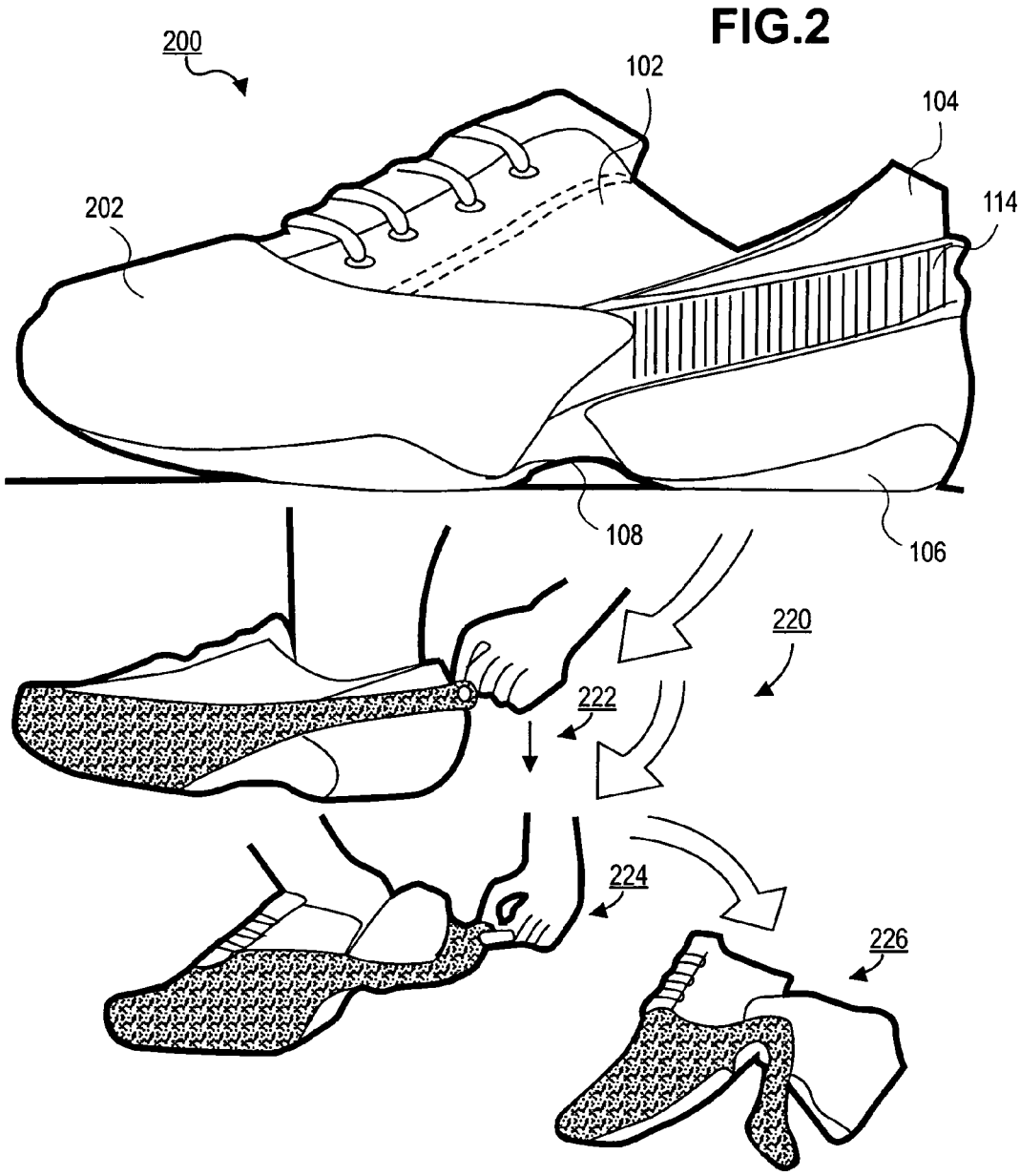
FIG. 2 provides a graphical illustration of footwear incorporating an example enhanced closure system, as well as an example method of operation, according to one example embodiment of the present invention.

FIG. 2 provides a graphical illustration of footwear incorporating an example enhanced closure system, as well as an example method of operation, according to one example embodiment of the present invention. In accordance with the illustrated example implementation of FIG. 2, footwear similar to that of FIG. 1 is generally employed comprising an upper having a forefoot portion 102 and a disparate rearfoot portion, and a sole 106 having a flexure member 108. In accordance with the teachings of the present invention, the rearfoot portion 104 of the upper is secured to the forefoot portion using an example embodiment of the enhanced closure system.

In accordance with the example implementation of FIG. 2, the ECS is depicted comprising a stretchable forefoot section 202, which engages a forefoot portion 102 of the footwear upper. The ECS also includes an engagement section 114, which movably secures a rearfoot portion 104 of the upper to the forefoot portion 102 of the upper, as shown. In accordance with one example implementation of the illustrated embodiment of the present invention, the anchor section 202 of the ECS is comprised of a "skin" captured between an outsole of sole 106 and the forefoot portion 102 of the footwear upper. According to one example embodiment, the skin is substantially comprised of an elastomeric material. In accordance with another example embodiment, not specifically depicted, the outer skin is slipped over the front portion of the shoe to engage the forefoot portion 102 of the upper using the elastic properties of the anchor section of the ECS. In this alternate embodiment, the anchor section 202 of the ECS is not captured between any elements of the shoe, but rather slides over the external elements of the shoe.

Turning to illustration 220 of FIG. 2, an example process for doffing (and, implicitly through following the process in a reverse order, donning) footwear employing the ECS of FIG. 2 is graphically depicted. In element 222, a user grasps the engagement section 114 of the ECS, and pulls the engagement section 114 out (i.e., away from the toes). In element 224, the user pulls down on the engagement section 114, thereby releasing the rearfoot portion 104 of the upper, as the sole 106 pivots about the flexure member 108. In element 226, the footwear of FIG. 2 is depicted in an open, or disengaged state.

Figure 3:
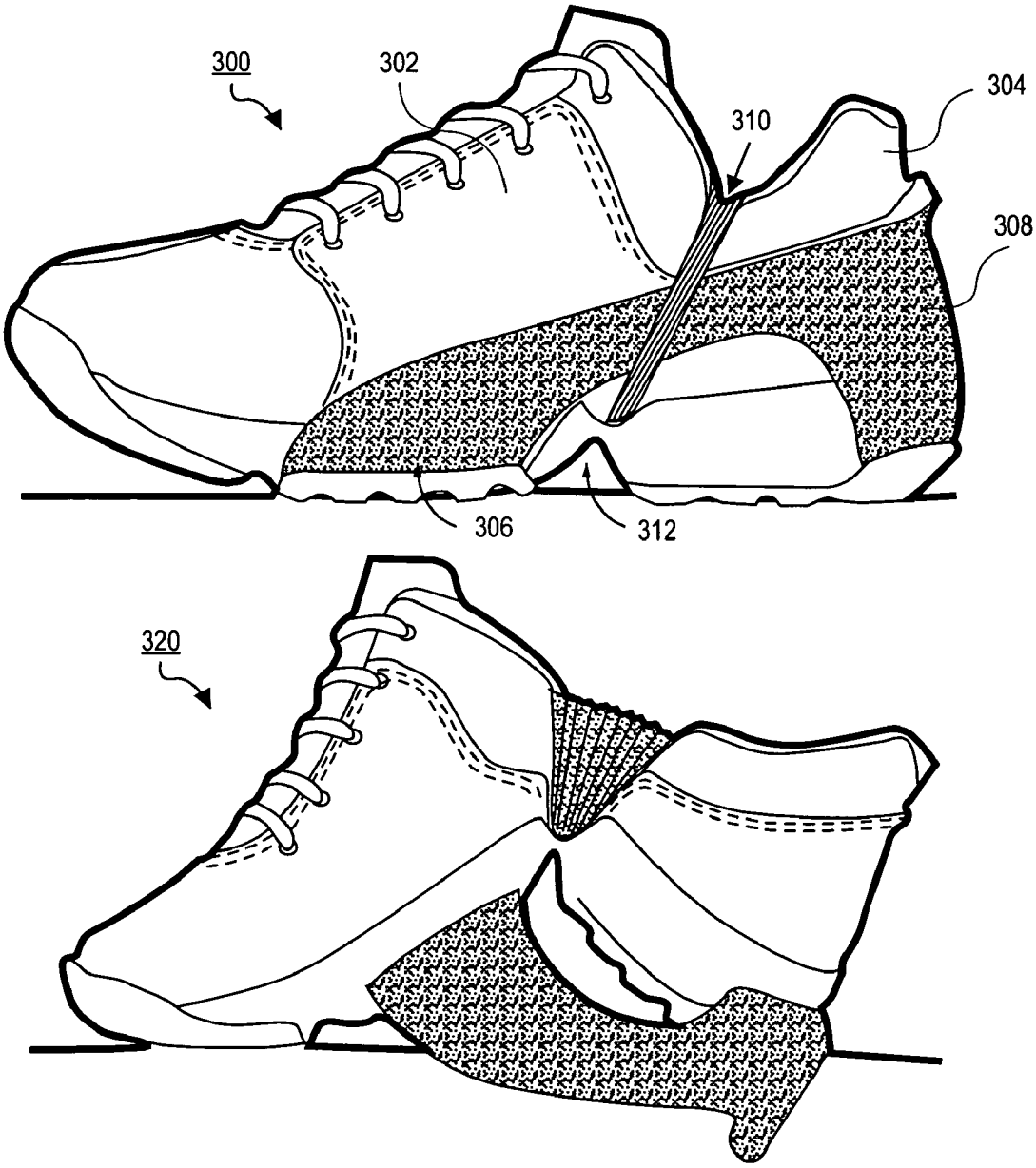
FIG. 3 is a side elevation of an article of footwear incorporating an example ECS in accordance with another example embodiment of the present invention.

FIG. 3 is a side elevation of an article of footwear incorporating an example ECS in accordance with another example embodiment of the present invention. In accordance with the illustrated example embodiment of FIG. 3, footwear is depicted in an open state 300. As shown, the footwear includes an upper generally comprised of a forefoot portion 302 movably coupled with a rearfoot portion 304 through an articulated section 310, a sole including a flexure member 312, and an example embodiment of an enhanced closure system (ECS) including an anchor section 306 and an engagement section 308, each coupled as depicted.

In accordance with the illustrated example implementation of FIG. 3, the engagement section 308 of the ECS is anchored 306 between the sole and the forefoot portion 302 of the upper. In such an implementation, disengaging the ECS is comprised of pulling the engagement section of the ECS out (i.e., away from the toes) and down (towards the heel), as depicted in illustration 320.

Figure 4:
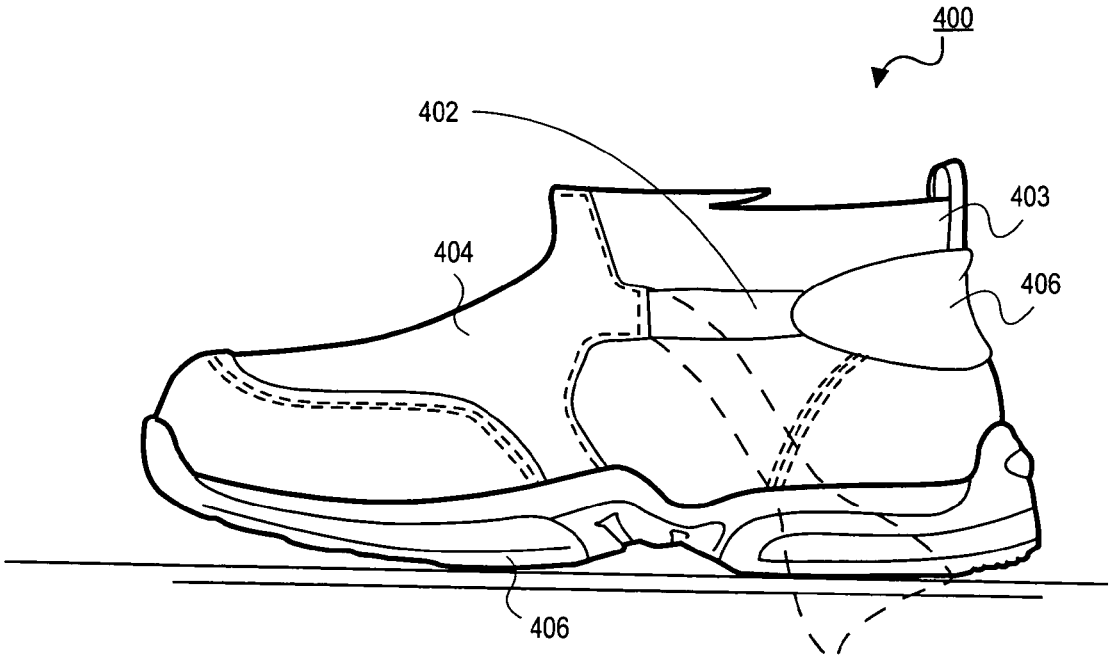
FIG. 4 is a side elevation of an article of footwear incorporating an example ECS in accordance with another example embodiment of the present invention.

FIG. 4 is a side elevation of an article of footwear incorporating an example ECS in accordance with another example embodiment of the present invention. In accordance with the illustrated example implementation of FIG. 4, an article of footwear 400 is depicted comprising an upper including a forefoot portion 404 and a rearfoot portion 403 loosely coupled with the forefoot portion 404 through an expanding boot, and a sole 406. As depicted, an example embodiment of the enhanced closure system is comprised of a movable engagement stirrup 402 including an ankle engagement 406, which engages the rearfoot portion 403 of the upper just above the heel in the ankle (or, Achilles tendon region of the foot) to secure the rearfoot portion 403 to the forefoot portion 404 of the upper.

As shown, the engagement stirrup 402 is anchored to the forefoot portion 404 of the upper. In accordance with but one example embodiment, the engagement stirrup 402 is a molded elastic stirrup that slips down under the heal during the donning/doffing of the footwear. The stirrup 402 is molded of TPU elastomer for stretch, support, and comfort.

Figure 5:
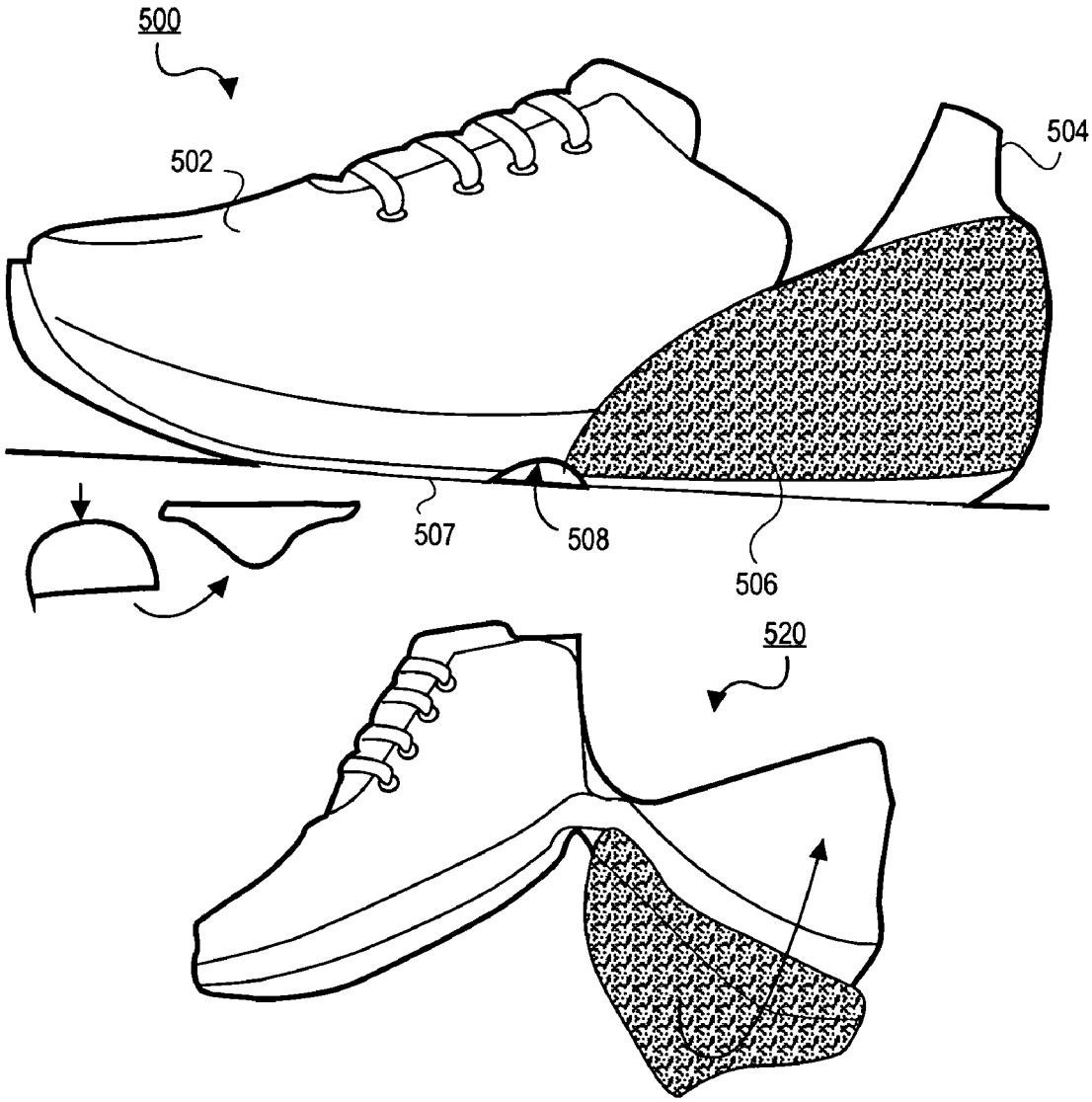
FIG. 5 is a side elevation of an article of footwear incorporating an example ECS in accordance with another example embodiment of the present invention.

FIG. 5 is a side elevation of an article of footwear incorporating an example ECS in accordance with another example embodiment of the present invention. In accordance with the illustrated example embodiment of FIG. 5, footwear 500 is depicted generally comprising an upper including a forefoot portion 502 and a disparate rearfoot portion 504, a sole 507 including a flexure member 508 and an example embodiment of an enhanced closure system 506. The illustration 520 depicts one example embodiment of the footwear 500 in a disengaged (or, open) state.

In accordance with the illustrated example embodiment of FIG. 5, the ECS 506 is comprised of a substantially elastomeric material at least a subset of which is captured between the rearfoot portion 504 of the upper and a rearfoot portion (i.e., from the heel to the flexure member 508) of the sole. According to one example embodiment, the ECS 506 includes elastic that is a stretchable material that forms a form-fit "skin" over a counter (heel portion) of the rearfoot portion 504 of the upper. According to one example embodiment, the ECS 506 is substantially transparent.

Figure 6:
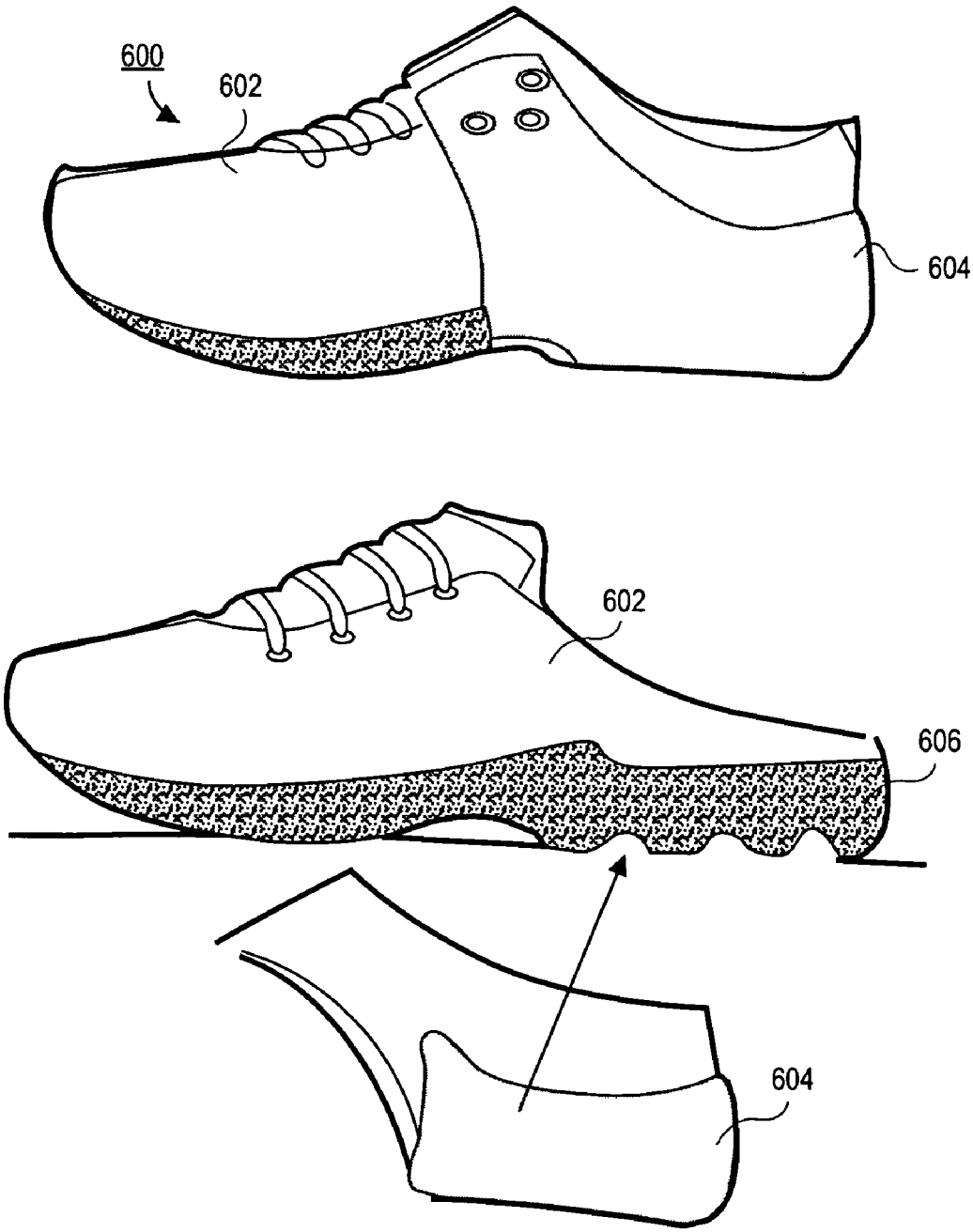
FIG. 6 is a side elevation of an article of footwear incorporating an example ECS in accordance with another example embodiment of the present invention.

FIG. 6 is a side elevation of an article of footwear incorporating an example ECS in accordance with another example embodiment of the present invention. More particularly, FIG. 6 illustrates an example embodiment of a two-part shoe comprising an internal clog element 602, and a removable external heel element 604, removably engaged by the clog element 602 using a scalloped sole element 606, as depicted. In accordance with the illustrated example embodiment of FIG. 6, the two-part shoe may be worn as a clog 602 by the user or, by attaching the external heel element 604, as a more conventional shoe (600).

In accordance with the illustrated example embodiment of FIG. 6, the clog element 602 includes a scalloped sole element 606, while the external heel element 604 includes an internal scalloped heel that complementarily receives the external scalloped sole element 606 of the clog 602 to create the shoe embodiment of the footwear. In accordance with one example implementation, the external heel element 604 could be comprised of an elastomeric material designed to engage a forefoot portion of the clog 602, thereby limiting vertical movement (slippage) of the external heel 604 relative to the clog 602. Horizontal movement of the heel element 604 relative to the clog element 602 is restricted through the use of complementary scallop elements of the disparate members, as depicted.

Figure 7:
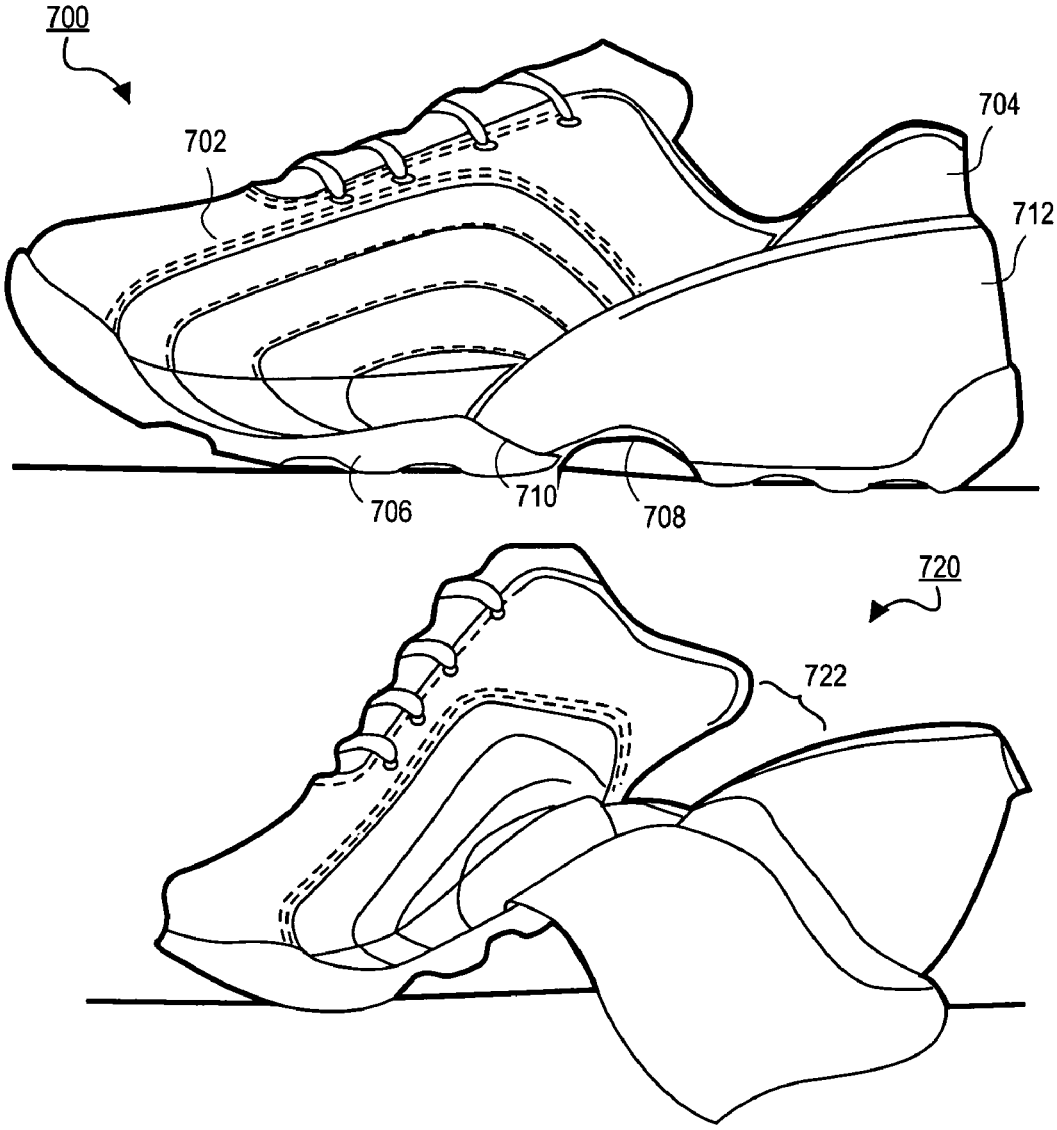
FIG. 7 is a side elevation of an article of footwear incorporating an example ECS in accordance with another example embodiment of the present invention.

FIG. 7 is a side elevation of an article of footwear incorporating an example ECS in accordance with another example embodiment of the present invention. In accordance with the illustrated example embodiment of FIG. 7, footwear 700 is generally depicted comprising an upper including a forefoot portion 702 and a disparate rearfoot portion 704, a sole 706 including a flexure member 708, and an example embodiment of an ECS including an anchor section 710 and an engagement section, 712. In accordance with the teachings of the present invention, at least the engagement section 712 of the ECS is movable relative to the anchor section 710 to removably engage the rearfoot portion of the upper 704, thereby securing the rearfoot portion 704 to the forefoot portion 702 of the upper.

According to one example implementation, the forefoot portion 702 is separated from the rearfoot portion 704 of the upper through an opening 722, as shown in illustration 720 depicting the footwear in a disengaged (open) state. The footwear may well include compression molded (EVA/fabric) quarters, which may help the forefoot strap up without the use of Velcro.

Figure 8:
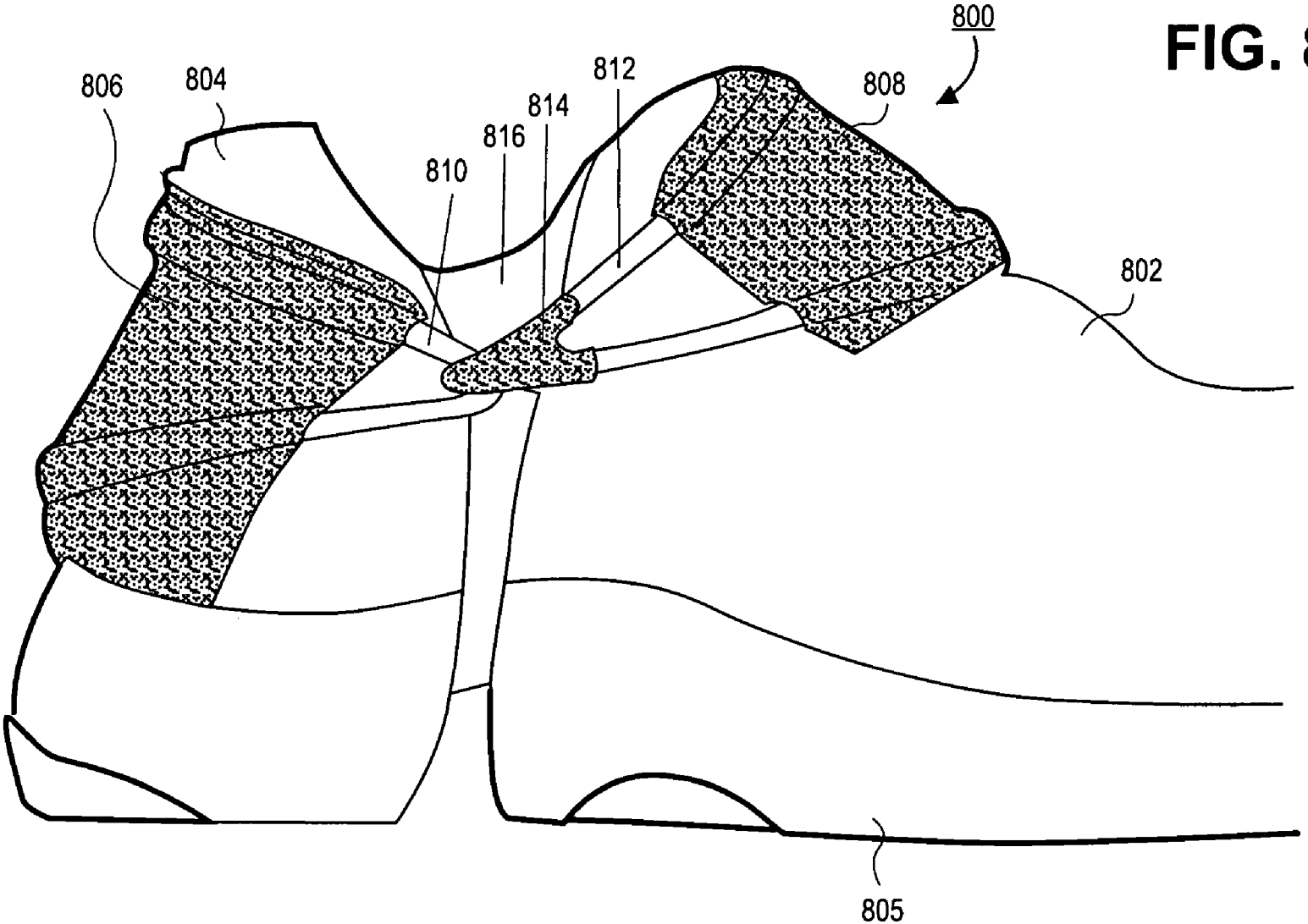
FIG. 8 is a side elevation of an article of footwear incorporating an example ECS in accordance with another example embodiment of the present invention.

FIG. 8 is a side elevation of an article of footwear incorporating an example ECS in accordance with another example embodiment of the present invention. In accordance with the illustrated example embodiment of FIG. 8, footwear 800 is depicted comprising an upper including a forefoot portion 802 and a rearfoot portion 804 coupled through an articulating section 816, a sole 805, and an example embodiment of an enhanced closure system (ECS). As depicted, the ECS is substantially comprised of two anchor sections, e.g., a rearfoot anchor 806 and a forefoot anchor 808, each having passed there through an elastomeric material (e.g., shock cord) 810, 812. As shown, the elastomeric engagement member of the forefoot portion 812 includes an engagement mechanism 814 to capture the elastomeric engagement member 810 of the rearfoot portion, thereby securing the rearfoot portion 804 to the forefoot portion 802 of the upper.

According to alternate embodiments of the present invention, the anchor elements 806, 808 may well be comprised of a (semi-) rigid fabric composite, a compression fabric and EVA, which is less rigid, a stretch leather, or elastomer, which is flexible and comfortable, while providing adequate support for the footwear.

Figure 9:
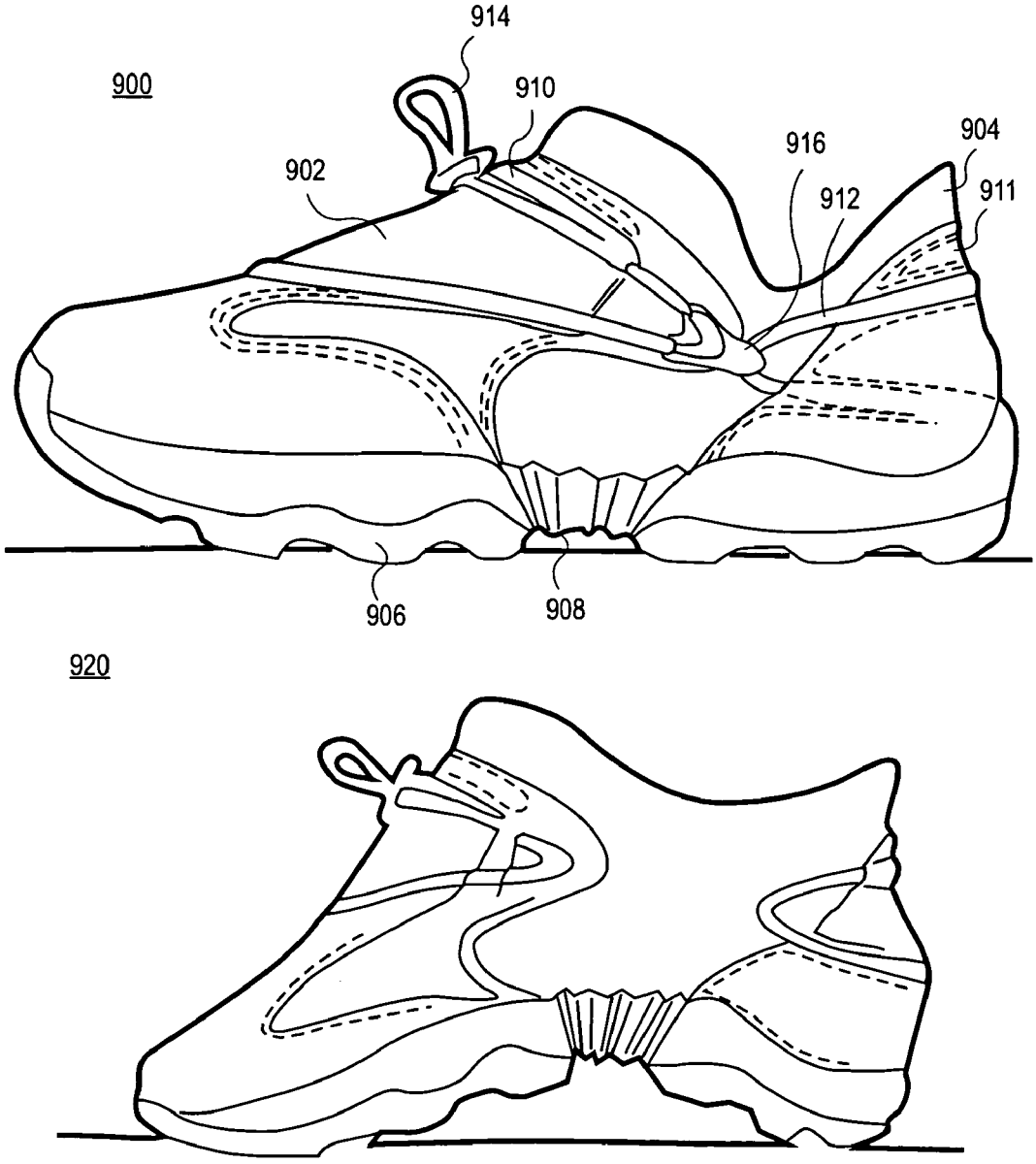
FIG. 9 is a side elevation of an article of footwear incorporating an example ECS in accordance with another example embodiment of the present invention.

FIG. 9 is a side elevation of an article of footwear incorporating an example ECS in accordance with another example embodiment of the present invention. In accordance with the illustrated example implementation of FIG. 9, an article of footwear is depicted comprising an upper including a forefoot portion 902 flexibly coupled with a rearfoot portion 904, a sole 906 including a flexure member 908, and an example embodiment of an ECS substantially comprised of an anchor section 910, 911, and a flexible engagement section 912, 914, respectively.

As shown, the anchor section includes a forefoot anchor section 910 and a rearfoot anchor section 911, each having passed there through a flexible engagement section 914 and 912, respectively. According to one example implementation, the engagement section is substantially comprised of a shock cord material. As depicted, the forefoot engagement section 914 includes an engagement mechanism 916 to secure the forefoot engagement element 914 to the rearfoot engagement element 912, securing the rearfoot portion 904 to the forefoot portion 902 of the sole. As depicted, the engagement mechanism 916 may well be comprised of over molded hardware, while the forefoot engagement element 914 may be adjustable by the user over the instep of the forefoot portion 902 of the upper. Illustration 920 depicts the footwear in a disengaged (open) state.

Figure 10:
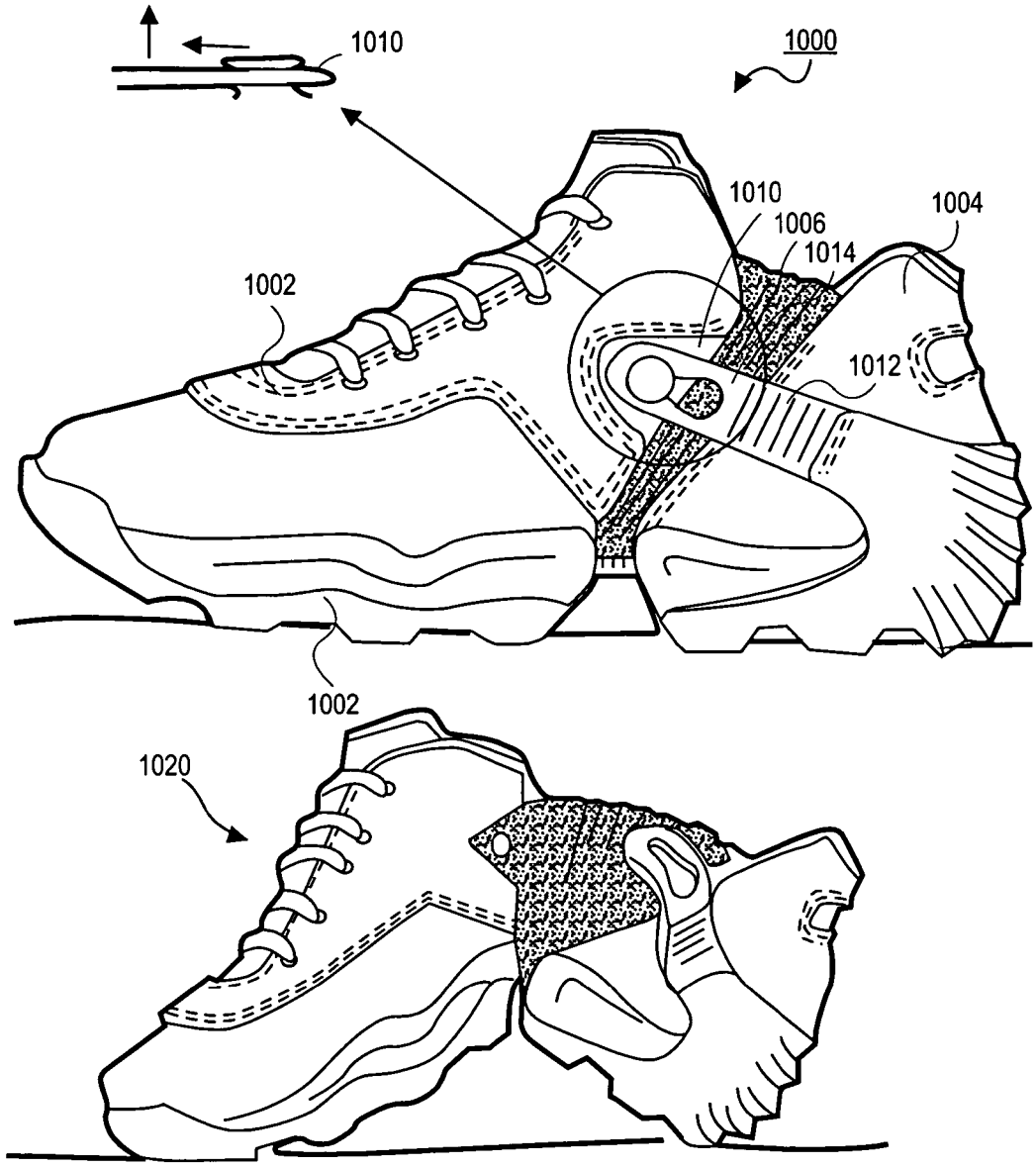
FIG. 10 is a side elevation of an article of footwear incorporating an example ECS in accordance with another example embodiment of the present invention.

FIG. 10 is a side elevation of an article of footwear incorporating an example ECS in accordance with another example embodiment of the present invention. In accordance with the illustrated example embodiment of FIG. 10, an article of footwear is depicted comprising an upper including a forefoot portion 1002 coupled to a rearfoot portion 1004 through an articulating segment 1006, a sole 1008, and an example embodiment of an ECS comprising an anchor section 1010 and an engagement section 1012 including an engagement mechanism 1014.

In accordance with the teachings of the present invention, a user grasps the engagement mechanism 1014 of the engagement section 1012 and pulls it towards the forefoot, engagement the engagement mechanism 1014 to the anchor section to secure the rearfoot portion 1004 of the upper to the forefoot portion 1002. An illustration of the footwear in the disengaged (open) state is also provided, 1020.

Figure 11:
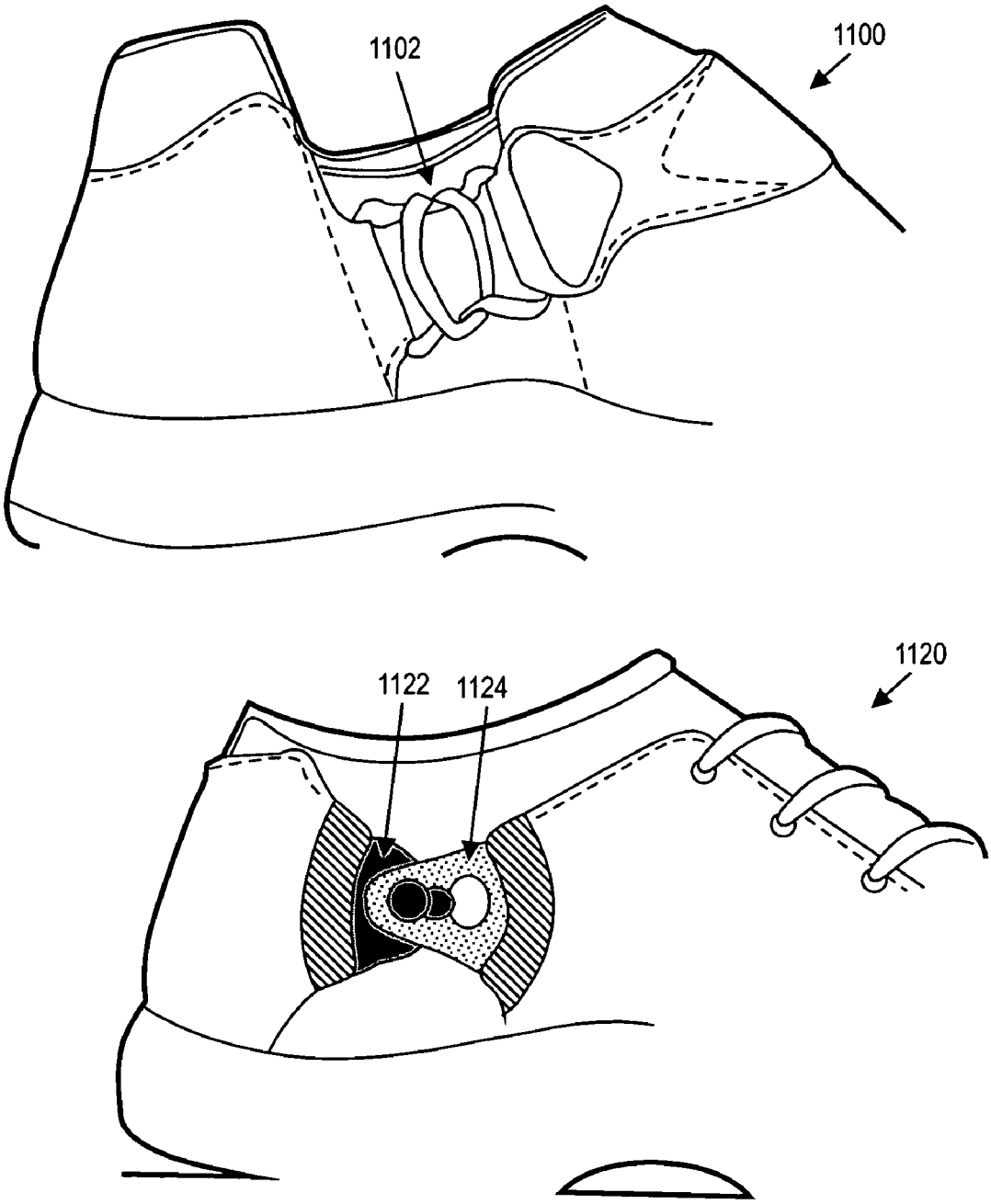
FIG. 11 is a side elevation of an article of footwear incorporating an example ECS in accordance with another example embodiment of the present invention.

FIG. 11 is a side elevation of an article of footwear incorporating an example ECS in accordance with another example embodiment of the present invention. In accordance with the illustrated example of FIG. 11, two disparate embodiments of an ECS are depicted. With reference to illustration 1100, an example embodiment of an enhanced closure system (ECS) is depicted substantially comprising overlapping clasps 1102, which are engaged as shown. In accordance with the illustrated example implementation of 1100, the overlapping clasps are stitched into an upper strap, wherein adjustment to fit of the footwear is made through the strap.

With reference to illustration 1120, an alternate example embodiment of the ECS is depicted wherein two engagement members 1122 and 1124 (mushrooms) coupled to the rearfoot and forefoot portions, respectively, of the upper through an elastomeric material. In accordance with the illustrated example implementation of illustration 1120, a male engagement member 1122 is removably coupled to a female engagement member 1124, as shown. In accordance with one example implementation, the engagement members include a low profile mushroom stitched into quarters. The mushroom has elastic on either side to provide adjustment.

Figure 12:
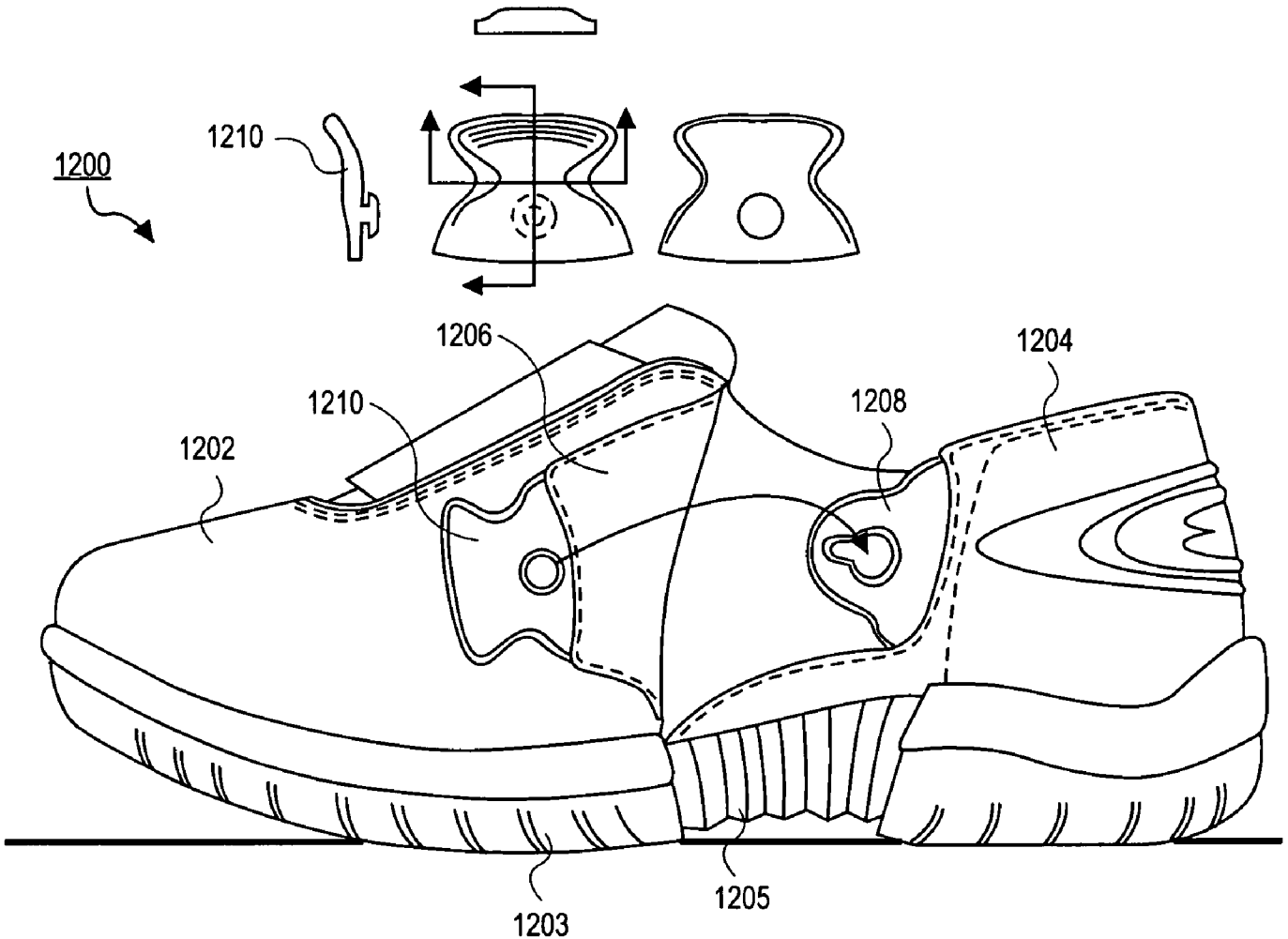
FIG. 12 is a side elevation of an article of footwear incorporating an example ECS in accordance with another example embodiment of the present invention.

FIG. 12 is a side elevation of an article of footwear incorporating an example ECS in accordance with another example embodiment of the present invention. As shown, footwear 1200 includes an upper including a forefoot portion 1202 and a flexibly coupled rearfoot portion 1204, a sole 1203 with a flexure member 1205, and an example embodiment of an ECS substantially comprised of an anchor section 1208 removably coupled with an engagement section 1206 including engagement mechanism 1210. A cross sectional view of engagement mechanism 1210 is depicted. In accordance with the illustrated example embodiment of the present invention, the engagement element 1206 is pulled over to the anchor element 1208, wherein the engagement mechanism 1210 removably engages a hole in the anchor section 1208 to secure the forefoot portion 1202 of the upper to a rearfoot portion 1204 of the upper.

Figure 13:
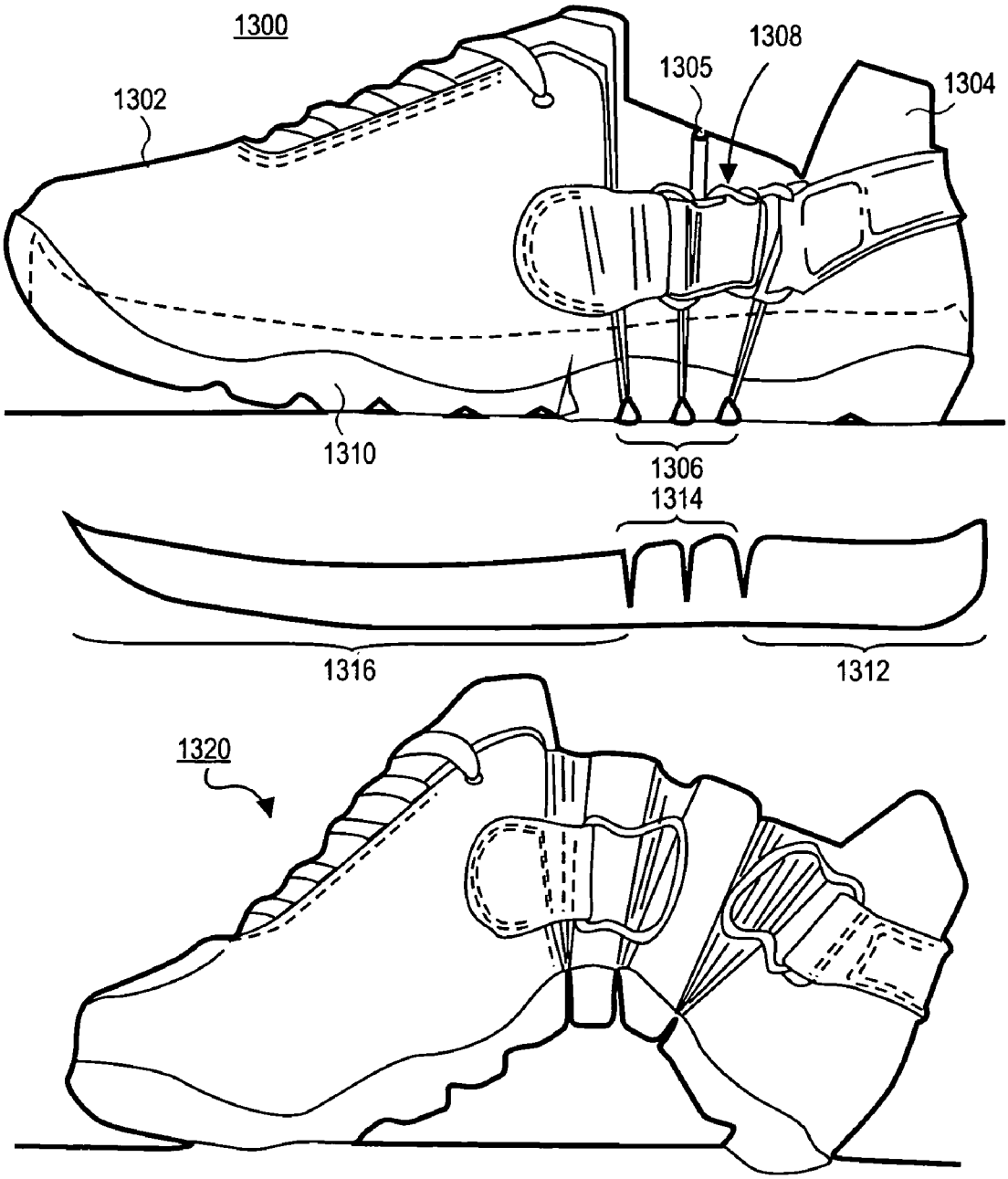
FIG. 13 is a side elevation of an article of footwear incorporating an example ECS in accordance with another example embodiment of the present invention.

FIG. 13 is a side elevation of an article of footwear incorporating an example ECS in accordance with another example embodiment of the present invention. More particularly, footwear 1300 is depicted comprising an upper including a forefoot portion 1302 flexibly coupled to a rearfoot portion 1304 through an articulating section 1305, a sole 1310 including flexure member 1306, and an embodiment of the ECS 1308, each coupled as depicted. In accordance with the illustrated example embodiment of the present invention, ECS 1308 is substantially comprised of interlocking clasps, as shown. A view of a disengaged state of the footwear is depicted with reference to 1320.

In addition, footwear 1300 is depicted comprising an insole segment substantially comprising a rearfoot portion 1312, an flexure portion 1314 and a forefoot portion 1316. In accordance with one example embodiment of the present invention, the flexure portion 1314 of the insole, and the flexure member 1306 of the sole, are located at a distance measured from the heel 35% of the distance to the tip of the forefoot portion 1316. Stated another way, the heel portion 1312 represents 35% of the length of the insole, or sole, respectively.

In accordance with another aspect of the present invention, the flexure member of the sole, or insole, may well include an active deflection retarding mechanism. That is, to provide added stability and support, although the flexure member 1306 and flexure portion 1314 allow the rearfoot portion 1304 of the upper to "drop away" from the forefoot portion 1302, thereby opening the foot opening, such flexure elements (1306, 1304) may also prevent the sole from deflecting back up past the horizontal plane. Such an active deflection retarding mechanism is depicted with reference to flexure portion 1314, which provides grooves which will effectively prevent the insole from deflecting past a certain point. As the grooves are compressed, deflection in the upward direction will be impeded by the material of the flexure portion.

Figure 14:
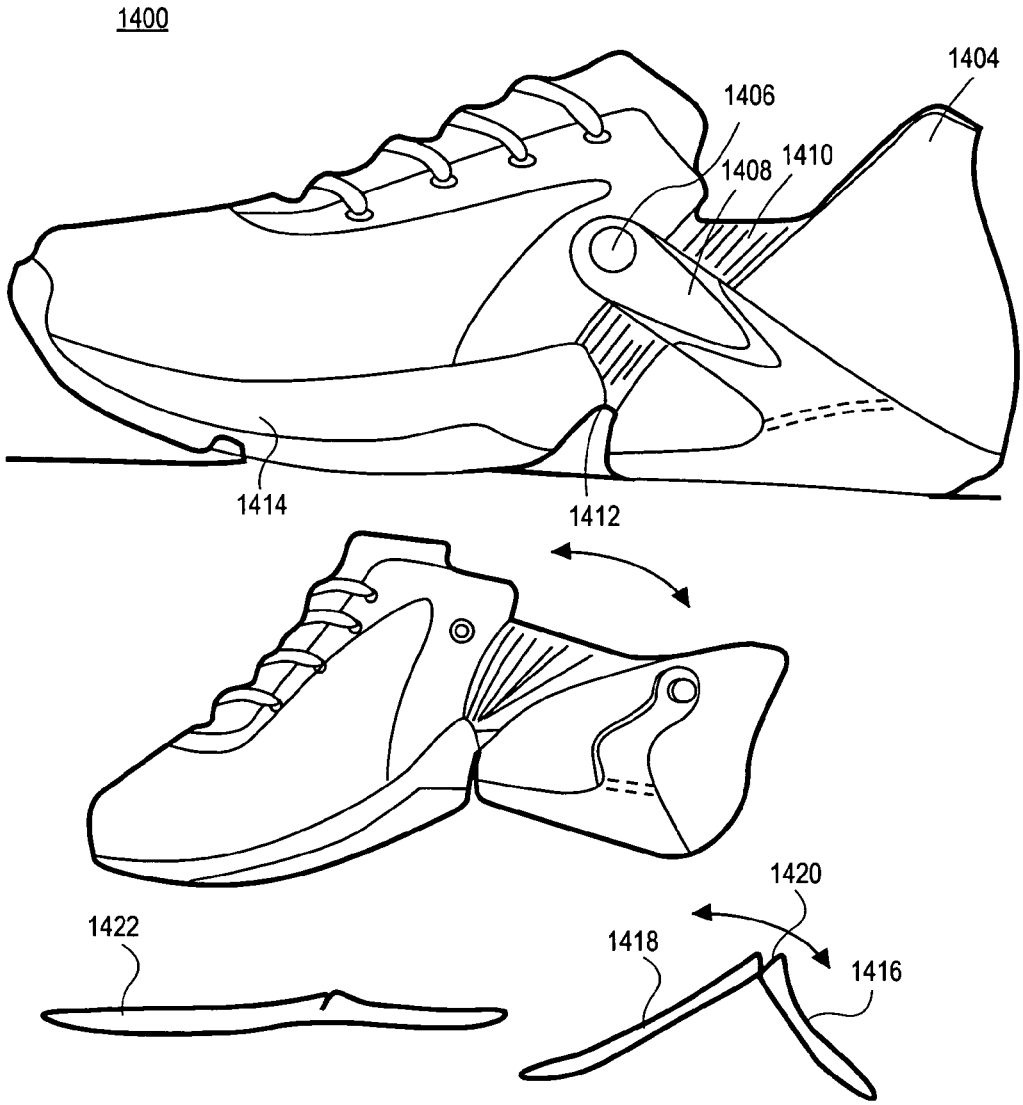
FIG. 14 is a side elevation of an article of footwear incorporating an example ECS in accordance with another example embodiment of the present invention.

FIG. 14 is a side elevation of an article of footwear incorporating an example ECS in accordance with another example embodiment of the present invention. As shown, footwear 1400 is depicted comprising an upper including a forefoot portion 1402 flexibly coupled to a rearfoot portion 1404 through a flexible portion 1410, a sole 1414 including a flexure member 1412, and an example embodiment of an enhanced closure system (ECS). As depicted the ECS includes an anchor section 1406, and an engagement section 1408. In accordance with but one example embodiment of the present invention, the ECS is substantially comprised of a hook and loop system, wherein one element is affixed to the anchor 1406, while the other element is coupled with the engagement section 1408. As shown, the engagement section 1408 is removably affixed to the anchor section 1406 to secure the rearfoot portion 1404 to the forefoot portion of the upper. An illustration of the footwear in a disengaged state is also depicted.

In addition, FIG. 14 illustrates an example embodiment of an active deflection retarding system, in accordance with but another aspect of the present invention. As shown, the sole, or insole is depicted comprising a rearfoot element 1416, a forefoot element 1418 and a flexure element 1420. As shown, the flexure element 1420 permits flexure, i.e., an opening of the sole (or, insole), but does not permit the sole to deflect substantially past a horizontal plane of the (in)sole. As provided above, such an active deflection retarding mechanism adds support and stability to footwear comprising flexure members.

Figure 15:
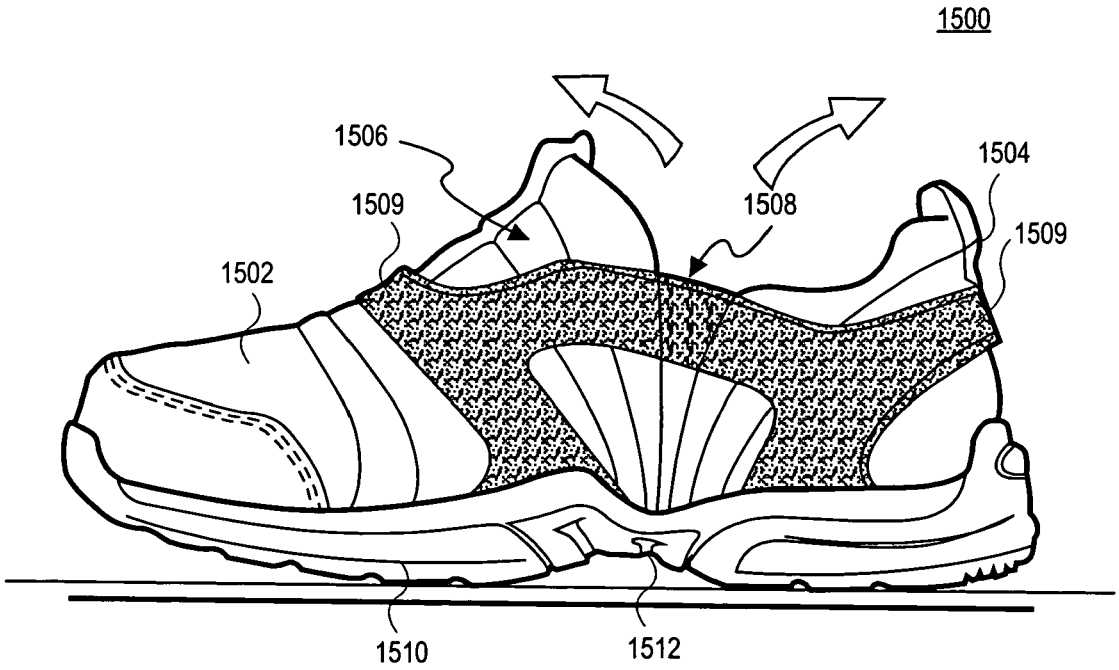
FIG. 15 is a side elevation of an article of footwear incorporating an example ECS in accordance with another example embodiment of the present invention.

FIG. 15 is a side elevation of an article of footwear incorporating an example ECS in accordance with another example embodiment of the present invention. As shown, footwear 1500 is depicted comprising an upper including a forefoot portion 1502 flexibly coupled with a rearfoot portion 1504, a sole 1510 including a flexure member 1512, and an example implementation of an ECS including anchor sections 1509 and an elastic engagement element 1508, each coupled as depicted.

According to one example embodiment, at least the forefoot portion 1502 includes stretch quarter panels 1506, which render the shoe more flexible and amenable to the ECS providing for a secure, yet comfortable fit.

Figure 16:
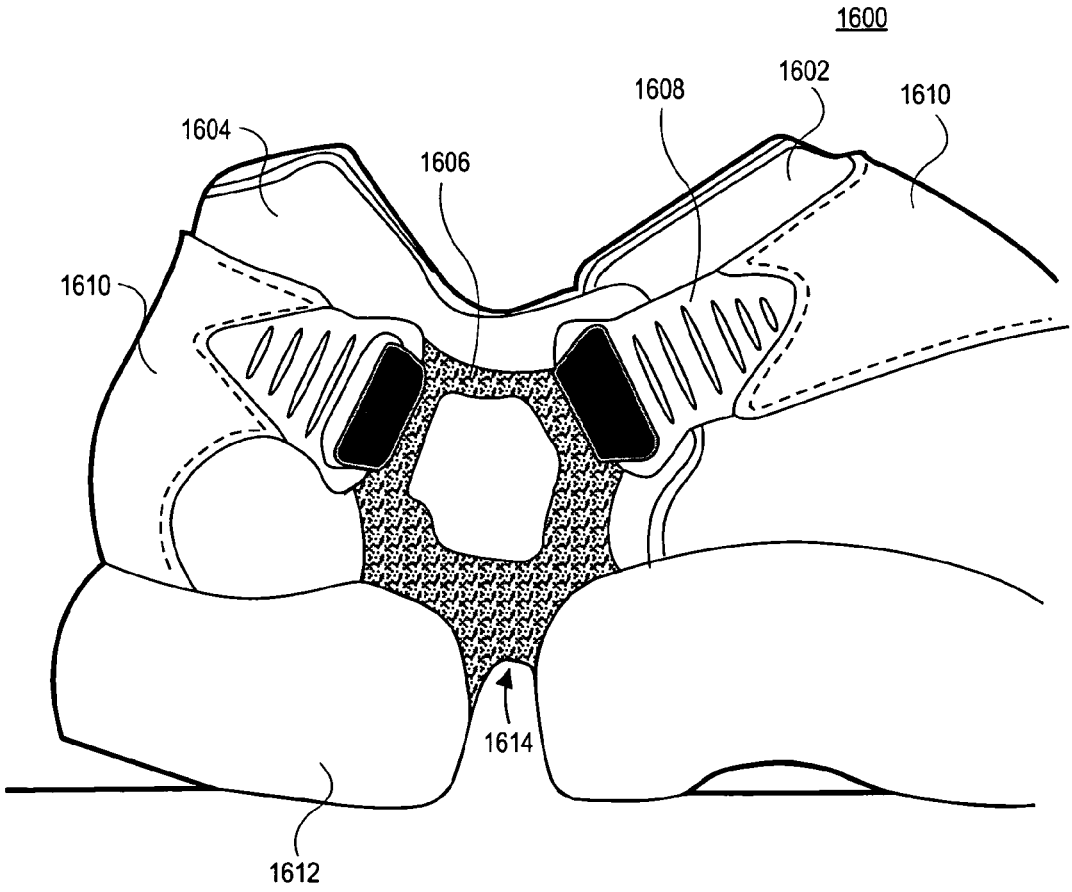
FIG. 16 is a side elevation of an article of footwear incorporating an example ECS in accordance with another example embodiment of the present invention.

FIG. 16 is a side elevation of an article of footwear incorporating an example ECS in accordance with another example embodiment of the present invention. As shown, footwear 1600 is depicted comprising an upper including a forefoot portion 1602 removably coupled with a rearfoot portion 1604, a sole 1612 including a flexure member 1614, and an example embodiment of an ECS to secure the rearfoot portion of the upper to the forefoot portion of the upper. As shown, the ECS is substantially comprised of an anchor harness 1606, which is coupled to the sole 1612 of the footwear, and engagement sections 1610 on the rearfoot and the forefoot each comprising molded straps with holes 1608, which removably engage the anchor harness 1606, as shown.

Figure 17:
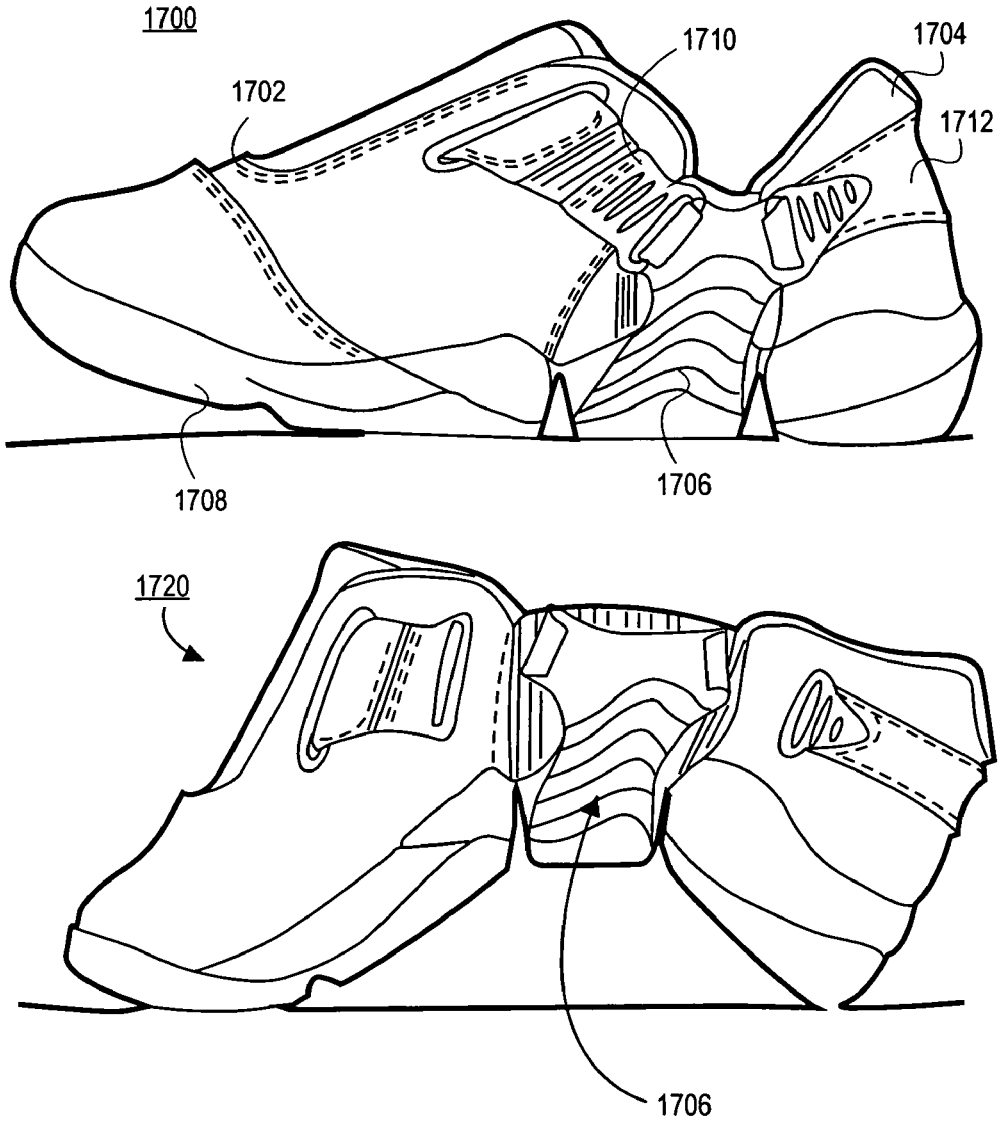
FIG. 17 is a side elevation of an article of footwear incorporating an example ECS in accordance with another example embodiment of the present invention.

FIG. 17 is a side elevation of an article of footwear incorporating an example ECS in accordance with another example embodiment of the present invention. In accordance with the illustrated example implementation of FIG. 17, an article of footwear is depicted comprising an upper including a forefoot section 1702 flexibly coupled to a rearfoot section 1704, a sole 1708 including a flexure member (not specifically denoted), and an example embodiment of an enhanced closure system (ECS), each coupled as shown. As depicted, the ECS comprises an anchor wing 1706 with engagement hooks for both a forefoot engagement element 1710 and a rearfoot engagement element 1712. In accordance with but one example implementation of the present invention, the anchor wing 1706 is integrated with the sole 1708. One or more of the engagement elements 1710 and 1712, respectively, are comprised of an elastomeric material, which may be adjusted to enable the user to size the fit of the footwear.

Although depicted in accordance with the example embodiments above, those skilled in the art will appreciate that these are but mere illustrations of the broader inventive elements of the teachings of the present invention. In that regard, embodiments of greater or less complexity are anticipated within the spirit and scope of the present invention, limited only by the language of the claims appended hereto.

What is claimed is:

1. A footwear closure system comprising:

a sole coupled to the upper including a forefoot sole and a rearfoot sole;

a flexure member coupled between the forefoot sole and the rearfoot sole to flexibly couple the rearfoot sole to the forefoot sole, wherein the flexure member is less stiff than the forefoot sole and includes at least one channel;

an anchor section, affixed to an upper connected to the forefoot sole; and an engagement section, coupled with the anchor section through an elastomeric material, to removably engage a rearfoot upper portion connected to the rearfoot sole, the engagement section to secure the rearfoot upper portion to the forefoot upper portion to enclose a foot of a wearer therein, wherein the engagement section forms a loop around the rearfoot upper portion such that a width of the engagement section is less than the width of the rearfoot upper portion.

2. The footwear closure system of claim 1, wherein the engagement section comprises a stretchable skin to fit over at least a part of the forefoot portion and removably fit over a part of the rearfoot portion to secure the forefoot portion to the rearfoot portion.

3. An article of footwear comprising:

an upper including a forefoot portion and a rearfoot portion;

a flexure member coupled between the forefoot sole and the rearfoot sole to flexibly couple the rearfoot sole to the forefoot sole, wherein the flexure member is less stiff than the forefoot sole and includes at least one channel; and a closure system including an anchor section, affixed to the upper forefoot portion; and an engagement section, coupled with the anchor section through an elastomeric material, to removably engage the forefoot upper to the upper rearfoot upper to enclose a foot of a wearer therein when engaged, wherein the engagement section forms a loop around the rearfoot upper portion such that a width of the engagement section is less than the width of the rearfoot upper portion.

4. The article of footwear of claim 3, wherein the engagement section comprises a stretchable skin to fit over at least a part of the forefoot portion and removably fit over a part of the rearfoot portion to secure the forefoot portion to the rearfoot portion.

5. The article of footwear of claim 4, further comprising:

a sole coupled to the upper including a forefoot sole and a rearfoot sole; and a flexure member coupled to the forefoot sole and the rearfoot sole and located between the forefoot sole and the rearfoot sole to hingedly couple the rearfoot sole to the forefoot sole.

6. The article of footwear of claim 3, wherein the engagement section comprises a stretchable skin to removably fit over at least a part of the forefoot portion and a part of the rearfoot portion.

7. The article of footwear of claim 6, further comprising:

a sole coupled to the upper including a forefoot sole and a rearfoot sole; and a flexure member coupled to the forefoot sole and the rearfoot sole and located between the forefoot sole and the rearfoot sole to hingedly couple the rearfoot sole to the forefoot sole.

8. The article of footwear of claim 6, wherein the stretchable skin is transparent.

* * * * *